US006151536A

United States Patent [19]

Arnold et al.

[11] Patent Number: 6,151,536

[45] Date of Patent: Nov. 21, 2000

[54] DISPENSING SYSTEM AND METHODS

[75] Inventors: Richard C. Arnold, Lamoine, Me.; John D. Higham, Menlo Park, Calif.

[73] Assignee: Omnicell.com, Palo Alto, Calif.

[21] Appl. No.: 09/162,251

[22] Filed: Sep. 28, 1998

[51] Int. Cl.[7] ..... G06F 17/00

[52] U.S. Cl. ..... 700/237; 700/236

[58] Field of Search ..... 700/236, 237, 700/244, 241, 242; 221/2

[56] References Cited

U.S. PATENT DOCUMENTS

| | | | |
|---|---|---|---|
| Re. 35,743 | 3/1998 | Pearson | 221/2 |
| 3,556,342 | 1/1971 | Guarr | 221/2 |
| 3,715,148 | 2/1973 | Beals | 312/209 |
| 3,744,867 | 7/1973 | Shaw | 312/234 |
| 3,762,601 | 10/1973 | McLaughlin | 221/2 |
| 3,917,045 | 11/1975 | Williams et al. | 194/4 |
| 3,998,356 | 12/1976 | Christensen | 221/2 |
| 4,019,793 | 4/1977 | Gerding | 312/209 |
| 4,071,747 | 1/1978 | Pantenella | 362/127 |
| 4,114,965 | 9/1978 | Oye et al. | 312/209 |

(List continued on next page.)

FOREIGN PATENT DOCUMENTS

| | | |
|---|---|---|
| 2130252 | 2/1996 | Canada . |
| 2650426 | 2/1991 | France . |
| 405147706 | 6/1993 | Japan . |
| 656613 | 4/1979 | U.S.S.R. . |
| WO 95/03587 | 2/1995 | WIPO . |
| WO 96/21925 | 7/1996 | WIPO . |
| WO 97/14104 | 4/1997 | WIPO . |
| WO 98/26746 | 6/1998 | WIPO . |

OTHER PUBLICATIONS

"Burnout: Why Do We Blame the Nurse" Drug ATM's Can Reduce Error Rate. *AJN* Nov. 1995).

Borel, Jacque et al., "Effect of an automated nursing unit--based drug–dispensing device on medication errors" *Am.J Health–Syst.Pharm* 52:1875–9, 1995.

Product Brochure, Access Automated Drug Control System, Lionvill Systems, Inc., print date Jul. 1993.

Product Brochure, Omnicell See and Touch Supply System, Omnicell Technologies, Inc., 1994.

*Primary Examiner*—Christopher P. Ellis
*Assistant Examiner*—Khoi H. Tran
*Attorney, Agent, or Firm*—Townsend and Townsend and Crew LLP

[57] ABSTRACT

The invention provides exemplary dispensing systems and methods for dispensing medical supply items. According to one exemplary method, a dispensing cabinet is provided having a processor. An auxiliary storage location is also provided and is separate from the dispensing cabinet. The auxiliary storage location has at least one door and at least one lock to lock the door, with the lock being operable upon receipt of a signal from the processor. Further, the auxiliary storage location holds at least one medical supply item. User identification information and charge account information are entered into the processor to cause the processor to send a signal to unlock the lock. An item sensor on the dispensing cabinet is actuated to record removal of the medical supply item from the auxiliary storage location. The medical supply item is then removed from the auxiliary storage location.

29 Claims, 5 Drawing Sheets

U.S. PATENT DOCUMENTS

| | | | |
|---|---|---|---|
| 4,179,724 | 12/1979 | Bonhomme | 361/391 |
| 4,209,211 | 6/1980 | Alford | 312/215 |
| 4,267,942 | 5/1981 | Wick, Jr. et al. | 221/2 |
| 4,360,125 | 11/1982 | Martindale et al. | 221/2 |
| 4,382,688 | 5/1983 | Machamer | 340/10 |
| 4,473,884 | 9/1984 | Behl | 364/479 |
| 4,575,719 | 3/1986 | Bertagna et al. | 340/825.35 |
| 4,626,105 | 12/1986 | Miller | 368/10 |
| 4,635,053 | 1/1987 | Banks et al. | 340/825.31 |
| 4,640,560 | 2/1987 | Blum | 312/234 |
| 4,691,470 | 9/1987 | Landell et al. | 43/55 |
| 4,695,954 | 9/1987 | Rose et al. | 364/413 |
| 4,717,042 | 1/1988 | McLaughlin | 221/3 |
| 4,737,910 | 4/1988 | Kimbrow | 364/403 |
| 4,783,740 | 11/1988 | Ishizawa et al. | 364/403 |
| 4,785,969 | 11/1988 | McLaughlin | 221/2 |
| 4,803,604 | 2/1989 | Nichols et al. | 362/154 |
| 4,811,764 | 3/1989 | McLaughlin | 141/98 |
| 4,813,753 | 3/1989 | Relyea | 312/291 |
| 4,847,764 | 7/1989 | Halvorson | 364/413.02 |
| 4,866,661 | 9/1989 | De Prins | 364/900 |
| 4,942,275 | 7/1990 | Addey et al. | 200/308 |
| 4,962,491 | 10/1990 | Schaeffer | 368/21 |
| 4,967,928 | 11/1990 | Carter | 221/2 |
| 5,014,875 | 5/1991 | McLaughlin et al. | 221/2 |
| 5,047,948 | 9/1991 | Turner | 364/479 |
| 5,055,660 | 10/1991 | Bertagna | 235/472 |
| 5,069,511 | 12/1991 | Swets et al. | 312/107.5 |
| 5,200,891 | 4/1993 | Kehr et al. | 364/413.01 |
| 5,242,223 | 9/1993 | Koves | 312/348.3 |
| 5,257,693 | 11/1993 | Kwasniak | 312/348.2 |
| 5,259,668 | 11/1993 | Teufel et al. | 312/249.11 |
| 5,263,596 | 11/1993 | Williams | 221/153 |
| 5,267,174 | 11/1993 | Kaufman et al. | 364/479 |
| 5,276,810 | 1/1994 | Kitamura et al. | 395/250 |
| 5,291,191 | 3/1994 | Moore | 340/825.35 |
| 5,292,029 | 3/1994 | Pearson | 221/2 |
| 5,314,243 | 5/1994 | McDonald et al. | 312/215 |
| 5,346,297 | 9/1994 | Colson, Jr. et al. | 312/215 |
| 5,355,289 | 10/1994 | Krenn | 362/253 |
| 5,381,315 | 1/1995 | Hamaguchi et al. | 361/727 |
| 5,392,951 | 2/1995 | Gardner et al. | 221/2 |
| 5,408,443 | 4/1995 | Weinberger | 368/10 |
| 5,459,648 | 10/1995 | Courtney | 362/154 |
| 5,460,294 | 10/1995 | Williams | 221/2 |
| 5,502,944 | 4/1996 | Kraft et al. | 53/55 |
| 5,537,313 | 7/1996 | Pirelli | 364/403 |
| 5,564,803 | 10/1996 | McDonald et al. | 312/215 |
| 5,611,051 | 3/1997 | Pirelli | 395/210 |
| 5,661,978 | 9/1997 | Holmes et al. | 62/3.6 |
| 5,664,856 | 9/1997 | Pacetti | 312/348.3 |
| 5,673,983 | 10/1997 | Carlson et al. | 312/218 |
| 5,745,366 | 4/1998 | Higham et al. | 364/479.12 |
| 5,805,455 | 9/1998 | Lipps | 364/479.01 |
| 5,805,456 | 9/1998 | Higham et al. | 364/479.06 |
| 5,905,653 | 5/1999 | Higham et al. | 364/479.14 |
| 6,011,999 | 9/1998 | Holmes | 364/479.01 |
| 6,039,467 | 3/2000 | Holmes | 364/479.01 |

DISPENSING SYSTEM AND METHODS

BACKGROUND OF THE INVENTION

The invention relates generally to the field of dispensing systems, and in particular to dispensing systems for the controlled dispensing of medical supply items, including pharmaceutical items. More particularly, the invention provides for the dispensing of items from an auxiliary storage location based on information input into a medical supply dispensing cabinet.

A relatively recent advancement in inventory practices within health care facilities is the use of medical supply cabinets that may be disposed at various strategic locations within the health care facility. In this way, the medical supply items may be stored at locations which are closer to the patients who need them. Exemplary dispensing units for dispensing medical supply items, including pharmaceuticals, are described in U.S. Pat. No. 5,745,366, and U.S. Pat. No. 5,805,455; 08/320,588, filed Oct. 11, 1995; and U.S. Pat. No. 5,805,456, U.S. Pat. No. 5,905,653, U.S. Pat. No. 6,039,467; and 08/985,034, filed Dec. 4, 1997; and PCT Application Nos. 94/07841 and 95/01025. The complete disclosures of all these references are herein incorporated by reference in their entirety.

Such dispensing units may include the use of item buttons which are disposed near where the items are stored within the dispensing unit. The item buttons are touched to record the removal or addition of items to or from the dispensing unit. The use of such item buttons has proved to be tremendously successful in the health care industry.

Due to their bulky nature, some medical supply items are ill suited for storage in a dispensing unit designed to hold relatively small medical supply items or pharmaceuticals. Such items can include, for example, crutches, adult diapers, "egg crate" foam pads, bed pans, and the like. Often, these items are stored in a storage room where maintenance of accurate inventories is difficult. Some have proposed the placement of a bar code label on the packaging of such items and the use of a bar code wand to record removal of the items. However, if the packaging is in the open, it is easy for the caregiver to remove the items without following bar code wanding procedures. As such, these procedures are often bypassed. Proper wanding procedures may also not be followed if the staff are not properly trained. As a result, such systems often fail to maintain an accurate accounting of inventory levels.

Hence, it would be desirable to provide a way to securely store large and/or bulky items while also providing a convenient way to maintain an accurate accounting of inventory levels. It would be particularly desirable to provide ways to easily and conveniently record the transfer of items to or from such storage locations. It would be further desirable if the techniques employed to store the large and bulky items could be compatible with existing dispensing units so that minimal modifications would need to be made in order to implement the techniques.

SUMMARY OF THE INVENTION

The invention provides exemplary systems and methods for dispensing medical supply items, including pharmaceuticals. In one exemplary system, a dispensing cabinet is provided having a processor with an entry device to enter user identification information and charge account information, such as a patient's identification number, into the processor. An auxiliary storage location is separate from the dispensing cabinet and has at least one door and a lock to lock the door. The lock is operated on receipt of a signal from the processor after the appropriate information has been entered into the processor. The dispensing cabinet further includes at least one item sensor which is in communication with the processor. The item sensor is actuated to record removal of an item from the auxiliary storage location.

Such a system is preferably operated by entering into the processor both user identification information and charge account information to cause the processor to send a signal to unlock the lock. After the lock has been unlocked, the user actuates one of the item sensors on the dispensing cabinet to record removal of a medical supply item from the auxiliary storage location. The user may then remove the medical supply item from the auxiliary storage location, with the removal having been previously recorded by actuation of the item sensor. In this way, medical supply items which are inconvenient to store within the dispensing cabinet may be stored at an auxiliary storage location which provides convenient access to the items. Further, an accurate accounting of the items in the auxiliary storage location is conveniently maintained by utilizing the processor in the dispensing cabinet.

The system of the invention is advantageous in that the dispensing cabinet may be coupled to a wide variety of storage locations including cabinets, closets, rooms, corridors, and the like. The system as described above is further advantageous in that the dispensing cabinet may be coupled to a plurality of auxiliary storage locations which each include a lock which is operated upon receipt of a signal from the processor after entry of the user identification and charge account information. In this way, a single dispensing cabinet may be employed to gain access to a wide variety of auxiliary storage locations.

In some cases, the auxiliary storage location will includes multiple items of the same type. If more than one of the same type of item is to be removed, the removal may be recorded by actuating the item sensor a number of times corresponding to the number of items that are to be taken. In one aspect, the auxiliary storage location may include a plurality of items of different types. With such a configuration, the dispensing cabinet preferably includes a plurality of item sensors which correspond to the different types of items. In this way, removal of different types of items from the auxiliary storage location may be recorded by actuating the item sensors on the dispensing cabinet that correspond to the types of items that are to be removed.

In another particular aspect, the dispensing cabinet includes at least one door and a lock to lock the door. The dispensing cabinet also holds a plurality of medical supply items and includes a plurality of dispensing cabinet associated item sensors which correspond to the medical supply items held in the dispensing cabinet. In this way, entry of the user identification and charge account information into the processor also unlocks the dispensing cabinet door. To record removal of one of the items from the dispensing cabinet, the dispensing cabinet associated sensor which corresponds to the item to be removed from the dispensing cabinet is actuated.

In one particularly preferable aspect, either the dispensing cabinet or the auxiliary storage location includes an exit button. The exit button is operated to send a signal to the processor the cause the processor to relock the lock. In this way, the items within the auxiliary storage location may be locked behind the door by simply pressing the exit button after completing a transaction. In yet another aspect, the processor may be configured to relock the lock after a predetermined amount of time has expired. In this way, if the user fails to press the exit button, the processor will cause the lock to lock after the expiration of a predetermined amount of time.

Conveniently, the lock on the auxiliary storage location may be electrically coupled to the processor. Alternatively, the processor of the dispensing cabinet may be wirelessly coupled to the lock so that an electrical cable is not required.

One particular feature of the invention is that the lock may be configured to be unlocked immediately upon entry of the user identification information and charge account information. Once the lock is open, the user then actuates the appropriate item sensor to record removal of an item that is to be removed. The user then walks over to the auxiliary storage location and removes the selected item. If assistance is needed in locating the appropriate item sensor, the user may optionally enter the name of the medical supply item into the processor. A visual indicator adjacent the item sensor is then lighted to indicate to the user the appropriate item sensor to actuate. Conveniently, the name of the medical supply item may be entered into the processor either before or after the lock is unlocked. To further assist the user, the processor may be configured to display a list of names of items that are stored in the auxiliary storage location so that the name may be conveniently selected while at the processor, to indicate which actuator to press. In another aspect, a written description of the position of the entered item may be displayed by the processor. In this way, the user will have written instructions as to where in the auxiliary storage location a selected item is located.

In still yet another aspect, the system is configured to conveniently allow for restocking of medical supply items into the auxiliary storage location. For example, the processor may be configured to generate a restock list prior to restocking. The restock list is generated based on item removal information that was previously recorded by the processor each time one of the item sensors was actuated. With the restock list, the user is able to restock the auxiliary cabinet by simply looking at the number and types of items that are to be placed within the auxiliary storage location. Conveniently, visual indicators which are adjacent the item sensors which correspond to the types of items to be restocked may be lighted. Upon placement of an item to be restocked into the auxiliary storage location, the restock technician simply actuates the corresponding item switch to record placement of the item into the auxiliary storage location.

The invention further provides a way to conveniently perform periodic cycle counts. This is accomplished by having the processor generate a list of items and associated quantities that the processor believes are held within the auxiliary storage location. The user then visually inspects the auxiliary storage location to determine if any discrepancies exist between the generated list and the items actually stored within the auxiliary storage location. The user may then return to the dispensing cabinet and update the information stored in the processor to eliminate any discrepancies. Preferably, the processor is updated by entering user identification information into the processor and then selecting a cycle count mode. The item sensors which correspond to items having a count discrepancy are then actuated a number of times corresponding to the size of the discrepancy.

DETAILED DESCRIPTION OF THE SPECIFIC EMBODIMENTS

The invention provides exemplary dispensing systems and methods which allow for the storage of various medical supply items in auxiliary storage locations while also controlling access to the items and maintaining an accurate accounting of their inventory levels. These features are obtained by coupling the auxiliary storage locations to dispensing cabinets which are selectively positioned at locations throughout a health care facility. The dispensing cabinets which may be used to control access to and maintain an accurate accounting of inventory levels of the supply items in the auxiliary storage locations may be constructed similar to those dispensing units described in U.S. Pat. No. 5,745,336, and co-pending U.S. application Ser. Nos. 08/250,223, filed May 27, 1994; U.S. Pat. No. 5,805,455; and U.S. Pat. No. 5,805,456, the disclosures of which are incorporated herein by reference.

The supplies stored in the auxiliary storage locations will typically comprise those supplies which are too large or bulky to fit within such dispensing cabinets. For example, such items may include crutches, adult diapers, "egg crate" foam pads, bed pans, and the like. However, it will be appreciated that essentially any type of item may be stored within the auxiliary storage locations. Preferably, the dispensing cabinets and auxiliary storage locations will be employed to store a wide variety of medical supply items, including pharmaceutical items.

The dispensing cabinets of the invention may be coupled to a wide variety of auxiliary storage locations, including other dispensing cabinets, closets, rooms, corridors, and the like. Such storage locations preferably include a door, drawer, or the like which must be opened in order to gain access to the interior of the auxiliary storage location. Locks are preferably provided to selectively prevent access to the items within the auxiliary storage locations. The locks of the auxiliary storage locations may be coupled to the dispensing cabinets in a variety of ways, including by an electrical cable, by a wireless transmitter, infra-red coupling, and the like.

The invention provides exemplary techniques for controlling operation of such locks based on information input into a processor of the dispensing cabinet. In this way, auxiliary storage space may be secured by use of a lock which is operated by entering information into existing dispensing cabinets. In this manner, the amount of storage space may be greatly increased with minimal cost. As described in greater detail hereinafter, the invention further provides for the use of item sensors on the dispensing cabinets which may be operated to record removal or addition of items from or to the auxiliary storage location. In this way, accurate inventory levels may be maintained for the items within the auxiliary storage locations using the processors within existing dispensing cabinets.

Figure 1:
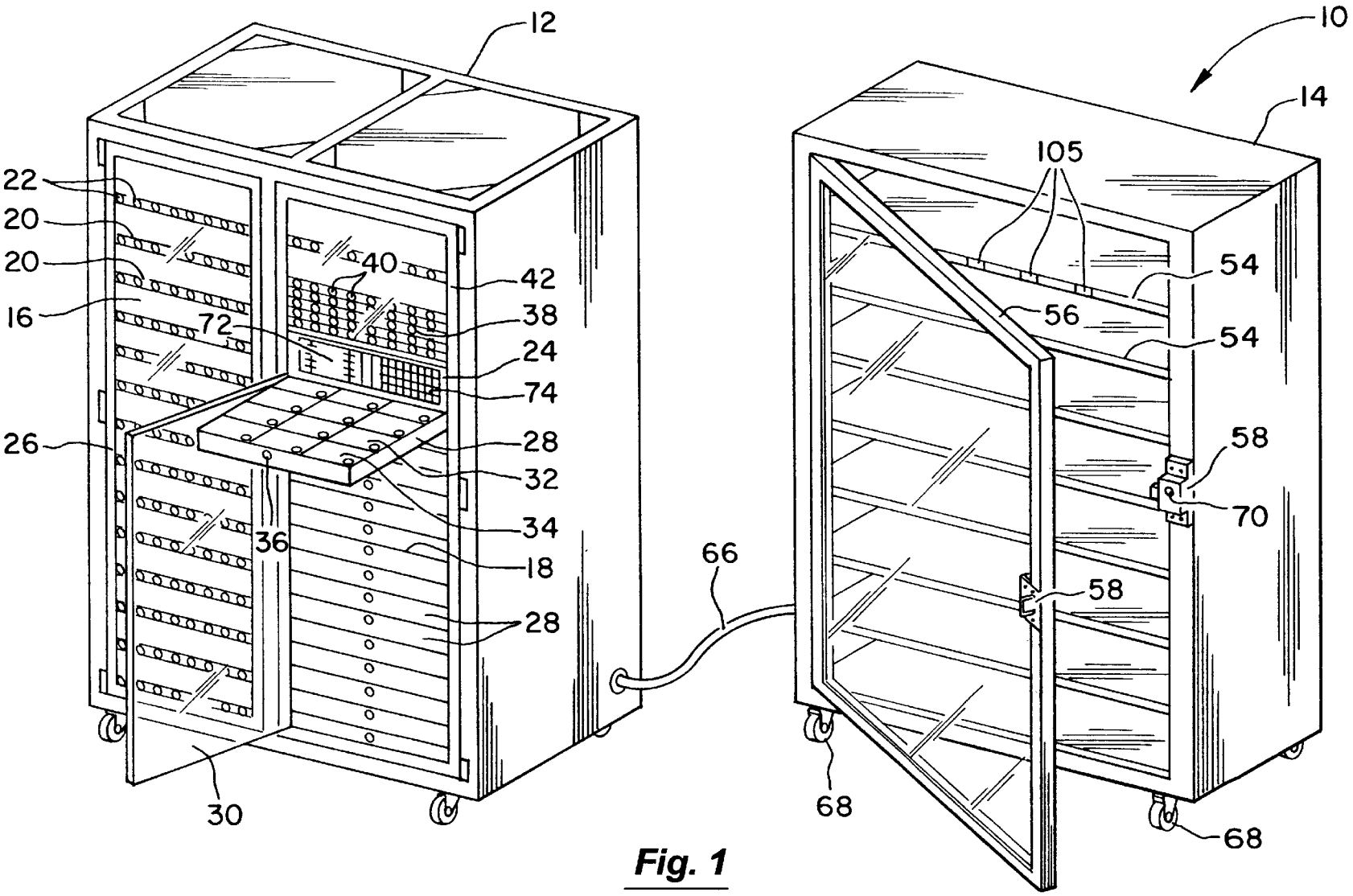
FIG. 1 illustrates an exemplary dispensing system having a dispensing cabinet coupled to an auxiliary storage unit according to the invention.

Referring now to FIG. 1, an exemplary embodiment of a dispensing system 10 will be described. Dispensing system 10 comprises a dispensing cabinet 12 and an auxiliary storage unit 14. As shown, dispensing cabinet 12 is similar to the dispensing cabinet described in U.S. Pat. No. 5,745,366, previously incorporated by reference. However, it will be appreciated that dispensing cabinet 12 may be configured to have other arrangements as previously described. For convenience of illustration, system 10 will be described in connection with the particular arrangement of dispensing cabinet 12.

Dispensing cabinet 12 includes a supply zone 16 and a pharmaceutical zone 18. Supply zone 16 includes a plurality of shelves 20 that are subdivided into a plurality of storage locations. A plurality of touch-sensitive item buttons 22 are provided on each shelf 20 for recording the transfer of an item to or from the storage location on shelf 20 simply by touching the item button once for each item added to or removed from the storage location as described in U.S. Pat. No. 5,745,366. Dispensing cabinet 12 further includes a processor 24 that is in communication with buttons 22 for recording transfer information as just described. Processor 24 is also employed to record transfer and other information for pharmaceutical zone 18.

A door 26 is disposed over supply zone 16. An internal lock (not shown) may optionally be provided to maintain door 26 locked. After appropriate information has been entered into processor 24, door 26 will be unlocked to allow access to the items as described in greater detail hereinafter.

Item buttons 22 are preferably configured to be illuminated so that they will serve as light indicators to help locate a particular item within supply zone 16. For example, if a user is unable to locate a particular item, the name of the item may be entered into processor 24 (or selected from a list of items stored in processor 24). The processor then sends a signal to light the particular button 22 which is adjacent the item that is to be removed. Alternatively, a visual indicator, such as an LED, may be positioned adjacent each button 22 to assist in locating a particular button 22.

Pharmaceutical zone 18 includes a plurality of pull-out drawers 28. A door 30 is optionally provided over drawers 28. A lock (not shown) similar to the lock used with door 26 may be employed to prevent access to drawers 28 until the necessary information is input into processor 24. Similarly, locks may be provided to selectively prevent access to drawers 28 based on information input into processor 24. At least some of drawers 28 are provided with a plurality of bins 32 which may optionally be covered with a lid 34. Each of drawers 28 may include a touch-sensitive drawer button 36 which may be touched to produce a record of access to a particular drawer. Buttons 36 may also serve as a visual indicator to assist in locating the particular drawer having an item that is requested from processor 24. Optionally, some of lids 34 may be provided with a lock to secure the lid in a closed position until receiving an unlock signal from processor 24.

Figure 2:
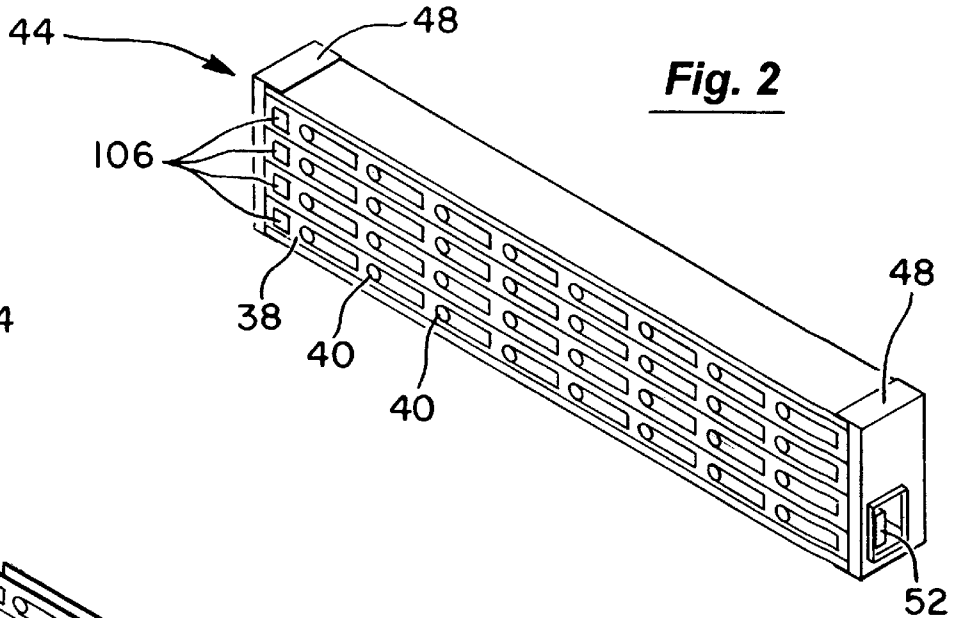
FIG. 2 illustrates an item button switch panel assembly of the dispensing cabinet of FIG. 1.
Figure 3:
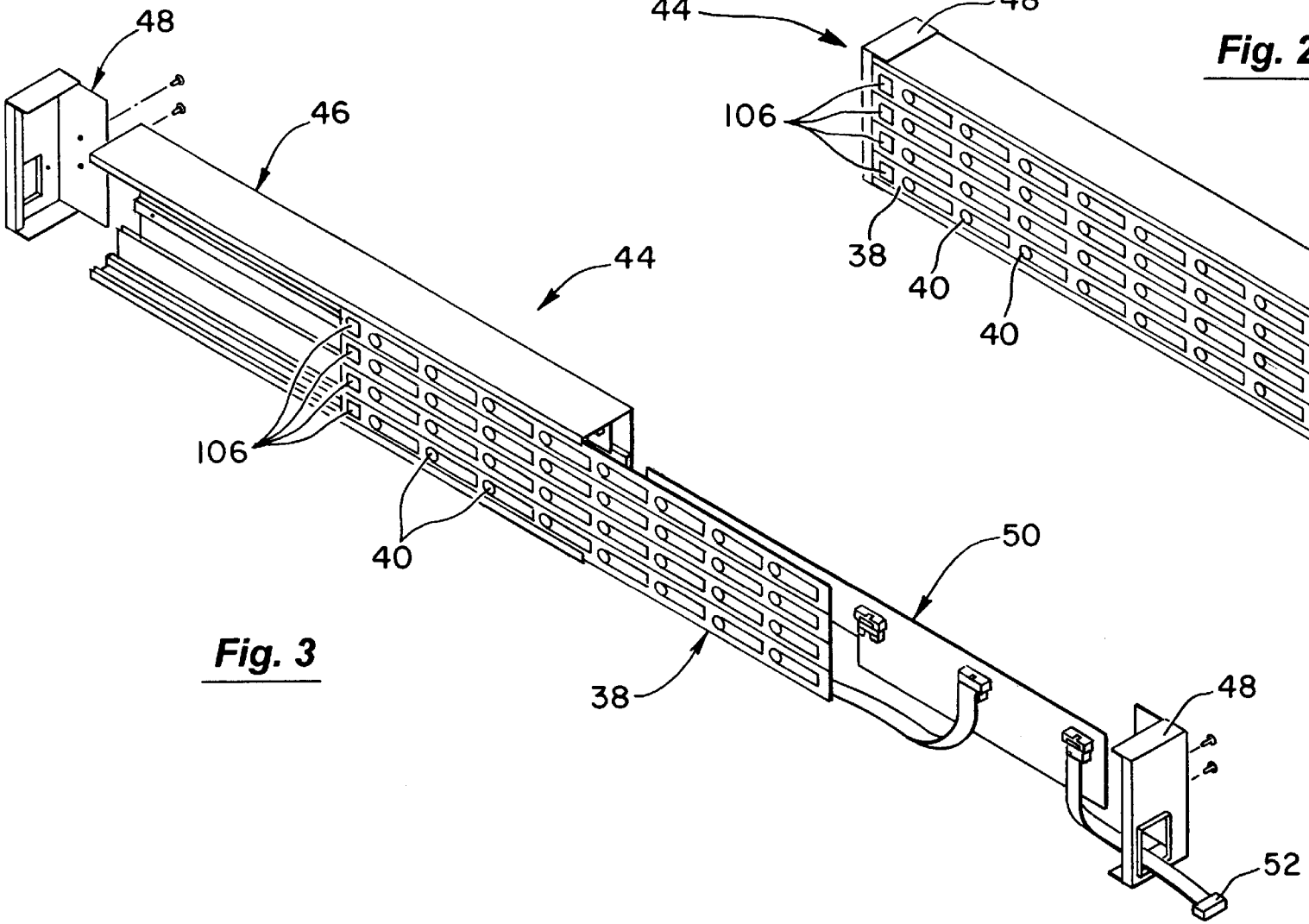
FIG. 3 illustrates an exploded view of the assembly of FIG. 2.

Dispensing cabinet 12 further includes a multi-array button switch panel 38 having an array of item buttons 40 which are associated with items stored within auxiliary storage unit 14. Optionally, a door 42 may be disposed over switch panel 38. Optionally, touch sensitive buttons on regular shelves 20 may be assigned to auxiliary items, but since this may in some cases render the shelf space above the row of buttons unusable, the compact, multi-button array panel 38 is preferred. As best shown in FIGS. 2 and 3, switch panel 38 is part of an assembly 44 which includes a switch panel housing 46 and a pair of frame mounting brackets 48 which are employed to mount assembly 44 to dispensing cabinet 12. Assembly 44 further includes a switch panel controller 50 which is electrically wired to each of buttons 40. In turn, controller 50 is placed in electrical communication with processor 24 via a connector 52. Assembly 44 is conveniently configured so that it may be easily placed into existing dispensing units such as those described in U.S. Pat. No. 5,745,336 and U.S. Pat. No. 5,805,455, previously incorporated by reference.

As shown, switch panel 38 includes 32 item buttons 40. However, it will be appreciated that different numbers and arrangements of item buttons may be included on dispensing cabinet 12 depending on the particular need. Conveniently, item buttons 40 may be illuminated to help a user locate a particular item button as described in greater detail hereinafter. Alternatively, a visual indicator, such as an LED, may be positioned adjacent each button 40 (typically within about one cm) to assist in locating a particular item button.

Figure 4:
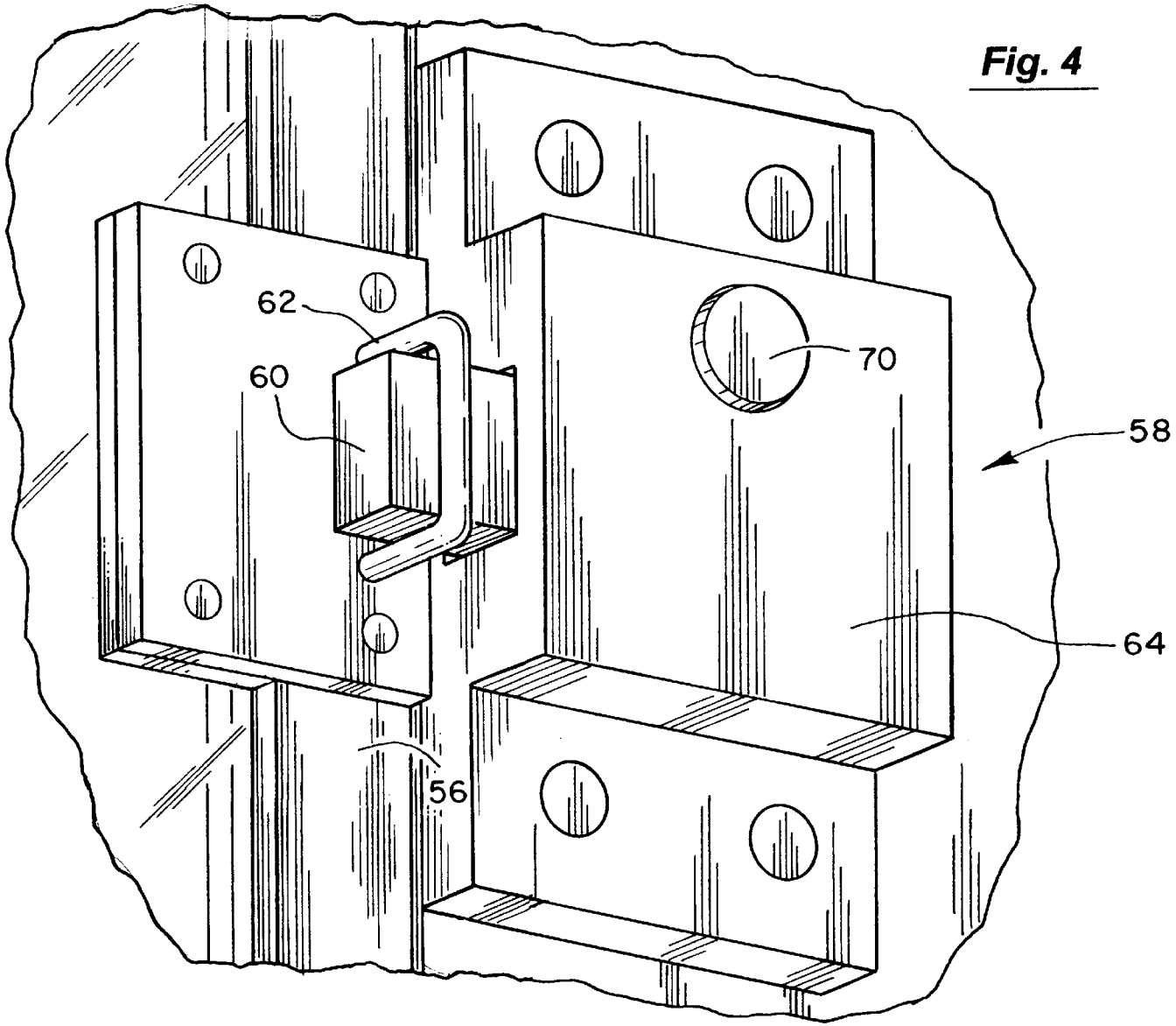
FIG. 4 is a more detailed view of a lock on the auxiliary storage unit of FIG. 1.

Referring back now to FIG. 1, construction of auxiliary storage unit 14 will be described in greater detail. Auxiliary storage unit 14 includes a plurality of shelves 54 and a door 56 to prevent access to items that are to be stored on shelves 54. Attached to unit 14 is a lock 58 to prevent opening of door 56. As best illustrated in FIG. 4, lock 58 comprises a latch 60 which is received into a latch pawl 62 to lock door 56 to auxiliary storage unit 14. Lock 58 further includes a housing 64 which includes a solenoid (not shown) which is operated upon receipt of an electrical signal to move latch 60 into and out of engagement with latch pawl 62.

Referring back to FIG. 1, dispensing cabinet 12 is electrically coupled to auxiliary storage unit 14 by a cable 66. In this manner, lock 58 may be operated upon receipt of electrical signals generated by processor 24. In this manner, a user may gain access to auxiliary storage unit 14 utilizing processor 24 of dispensing cabinet 12. As such, auxiliary storage unit 14 may be constructed relatively inexpensively and be operated using more expensive components which are shared with dispensing cabinet 12.

Item buttons 40 on switch panel 38 are configured to correspond to specific locations within auxiliary storage unit 14. For example, as shown auxiliary storage unit 14 includes eight shelves. As such, the first row of item buttons 40 on switch panel 38 may be configured to correspond to the first two shelves in auxiliary storage unit 14, the second row to the next two shelves and so on. The remaining item buttons 40 would not be activated unless more storage locations were provided within auxiliary storage unit 14. Item buttons 40 are preferably constructed to operate in a manner similar to item buttons 22 in supply zone 16. More specifically, to record removal of an item from one of shelves 54, the user simply presses item button 14 a number of times corresponding to the number of items to be removed. In a similar manner, items may be restocked onto a particular shelf 54 and the transaction recorded by touching the associated item button 40 on dispensing cabinet 12 a number of times corresponding to the number of items to be restocked.

Conveniently, auxiliary storage unit 14 is placed on wheels or casters 68 to allow it to be moved to different locations within the health care facility. The length of cable 66 may be adjusted to accommodate for the amount of separation from dispensing cabinet 12. Alternatively, a wireless transmitter and receiver may be employed to operate lock 58 based on information input into processor 24.

As described in greater detail hereinafter with reference to FIG. 5, lock 58 may be placed on a variety of doors so that dispensing cabinet 12 will be useful in connection with a wide variety of storage locations, including storage rooms, closets, cabinets, and the like.

Figure 6:
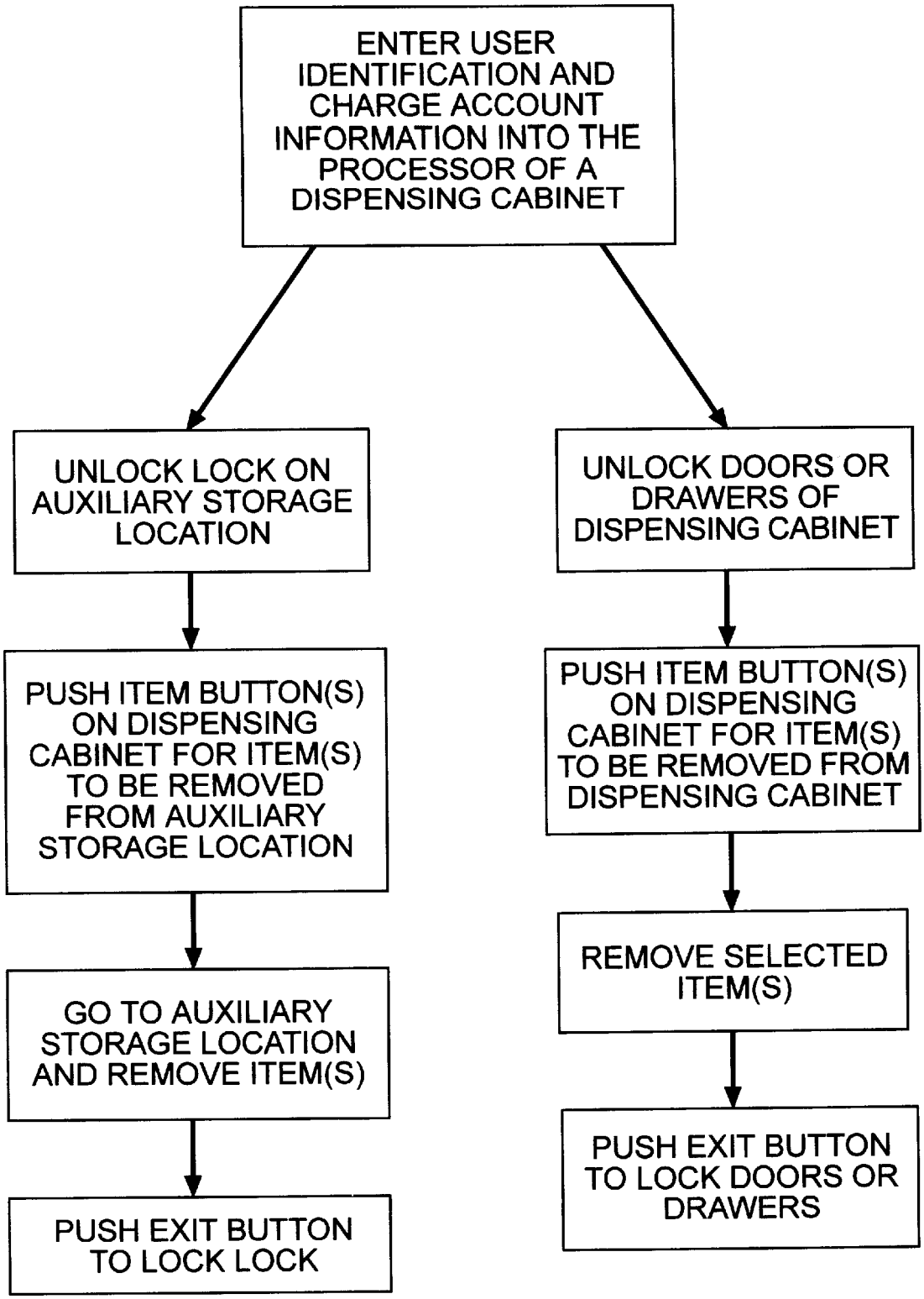
FIG. 6 is a flowchart illustrating an exemplary method for dispensing items from the dispensing system of FIG. 1.

Referring now to FIG. 6, an exemplary method for utilizing dispensing system 10 to dispense medical supply items will be described. Initially, a user approaches dispensing cabinet 12 and enters user identification information, such as a user name and password, into processor 24. The user also enters in charge account information into processor 24. Such charge account information can include, for example, the patient's name or other entity who is responsible for the charges. Upon entry of both user identification information and charge account information into processor 24, a signal is sent to unlock lock 58 so that access to shelves 54 may be obtained by opening door 56. At the same time, one or more doors of dispensing cabinet 12 may also be unlocked. For security reasons, some of the doors on dispensing cabinet 12 may be kept locked until additional information is entered.

Once door 56 is unlocked, the user records removal of one or more items from auxiliary storage unit 14 by pressing item buttons 40. For example, if an item on top shelf 54 is to be removed, a first one of buttons 40 may be pressed once. For each additional item of the same type that is to be removed, button 40 is pressed a corresponding number of times. If another type of item is to be removed from another one of shelves 54, the corresponding item button 40 on switch panel 38 is pressed.

If the user needs assistance in determining the correct item button 40 to press to record removal of an item from auxiliary storage unit 14, the name of the item or other information may be entered into processor 24 which will cause the appropriate item button 40 to be lighted. Optionally, a user may scroll through a list of item names produced by processor 24 to select the desired item. After the appropriate item buttons 40 have been pressed, the user approaches auxiliary storage unit 14, opens door 56 and removes the previously selected items. To assist the user in selecting the items, labels 105 will be typically affixed to the shelves. Also, the order of the items on the shelves will typically correspond to the order of the items designated on the switch panel 38. When finished, the user closes door 56. Lock 58 may further include an exit button 70 which the user pushes to indicate to processor 24 that the transaction is complete. Upon receipt of a signal from exit button 70, processor 24 sends a signal to lock 58 to lock door 56. Although shown as being disposed on lock 58, exit button 70 may be included on dispensing cabinet 12 as well. Optionally, processor 24 may include a timer which is set to automatically lock 58 if exit button 70 is not pressed within a predetermined amount of time. In this way, if the user neglects to actuate exit button 70, lock 58 will lock to secure items within auxiliary storage unit 14. Similarly, the doors on dispensing cabinet 12 may be locked after a predetermined amount of time has expired.

Processor 24 may optionally be configured to display information regarding the location of particular items stored within auxiliary storage unit 14, as well as the location of auxiliary storage unit 14 if not in view. Such information may be obtained by having the user enter into processor 24 the name of the item (or selecting the name from a list of names) and having processor 24 visually displaying a written description of the location on a screen 72.

After user identification information and charge account information have been entered into processor 24, the user may also remove various items from dispensing cabinet 12 by opening the appropriate door and pressing item button 20 if the item is within supply zone 16 as described in U.S. Pat. No. 5,745,366. Similarly, items may be removed from pharmacy zone 18 in a manner described in U.S. Pat. No. 5,745,366.

When returning unused items to the auxiliary storage unit 14, a user enters user identification information into processor 24 and then enters a return mode by pressing a return button 106 at the end of the switch panel 38. Actuation of the return button is preferably indicated by flashing the light indicators on that switch panel row, indicating that pushing the touch sensitive button will record a return, rather than an issue. The switch panel is returned to its normal mode, either by pushing the return button 106 a second time, or pushing a button on another switch panel, or when the user logs out of the machine. If a particular item is to be credited to a patient, the user may also enter charge account information into processor 24. When in return mode, the user simply presses item buttons 40 corresponding to the items that are to be returned, pressing each button the correct number of times corresponding to the number of items being returned. The items are then placed onto shelves 54 and exit button 70 is pressed to end the session.

Of course, it will be appreciated that a separate return button may be provided next to each button 40. In this way, a return may be recorded simply by pressing the appropriate return button. However, due to the reduced circuitry, use of a return button at the end of each row is preferred.

From time to time it is necessary to restock both the dispensing cabinet and the auxiliary cabinet to replace the items that have been used. Conveniently, processor 24 may include a printer (not shown) which is able to generate a restock list containing a list of items that are to be restocked. Alternatively, such a restock list may be generated at a central location. To assist the restock technician in the restocking process, item buttons 40 which correspond to items that to be restocked may be lighted in a flashing mode. In this way, the user may simply look at the restock list to determine the quantity of items that are to be replenished and then touch the corresponding flashing item buttons 40 a number of times corresponding to the number of items to be replenished.

Alternatively, the processor 24 is sent information describing which items will be restocked and the quantity of each item that will be on the restock list. In such a case, to further assist the restock technician in the restocking process, item buttons 40 (or a visual indicator adjacent each button 40) which correspond to items to be restocked may be lit using a flashing mode. When the restock technician touches the touch sensitive button 40 next to a particular flashing indicator, the light next to that button displays full on, to indicate that it has been selected. Further, the quantity expected for that item is displayed on the screen of the processor 24. The quantity may be modified by the restock technician if it is not correct, but in most cases this will correspond to the quantity actually picked. The quantity is acknowledged by pressing the touch sensitive button just once, at which point the adjacent light goes out, indicating that that item has been replenished. This saves the restock technician from having to push the item button the number of times corresponding to the number of items being restocked. For large quantities, this saves considerable time. In addition the completion of the restocking process is clearly indicated by the fact that all the flashing lights are out.

Processor 24 may also include a cycle count mode which allows a user to determine if there are any discrepancies between the records of processor 24 and the actual number of items held within the auxiliary storage unit 14. Such a task is preferably accomplished by generating a list of items and associated quantities that are held within auxiliary storage unit 14 from the information stored within processor 24. Using the list, the user visually inspects the items stored within auxiliary storage unit 14 to determine any discrepancies in the generated list. The user may then update the information stored in processor 24 to eliminate any discrepancies. Preferably, any discrepancies are corrected by having the user enter user identification information into processor 24 and then placing processor 24 into the cycle count mode. Item buttons 40 which correspond to items having a count discrepancy are then touched, and the correct quantity of the item stored in auxiliary storage unit 14 is entered into the processor 24, preferably by using a keypad 74.

Figure 5:
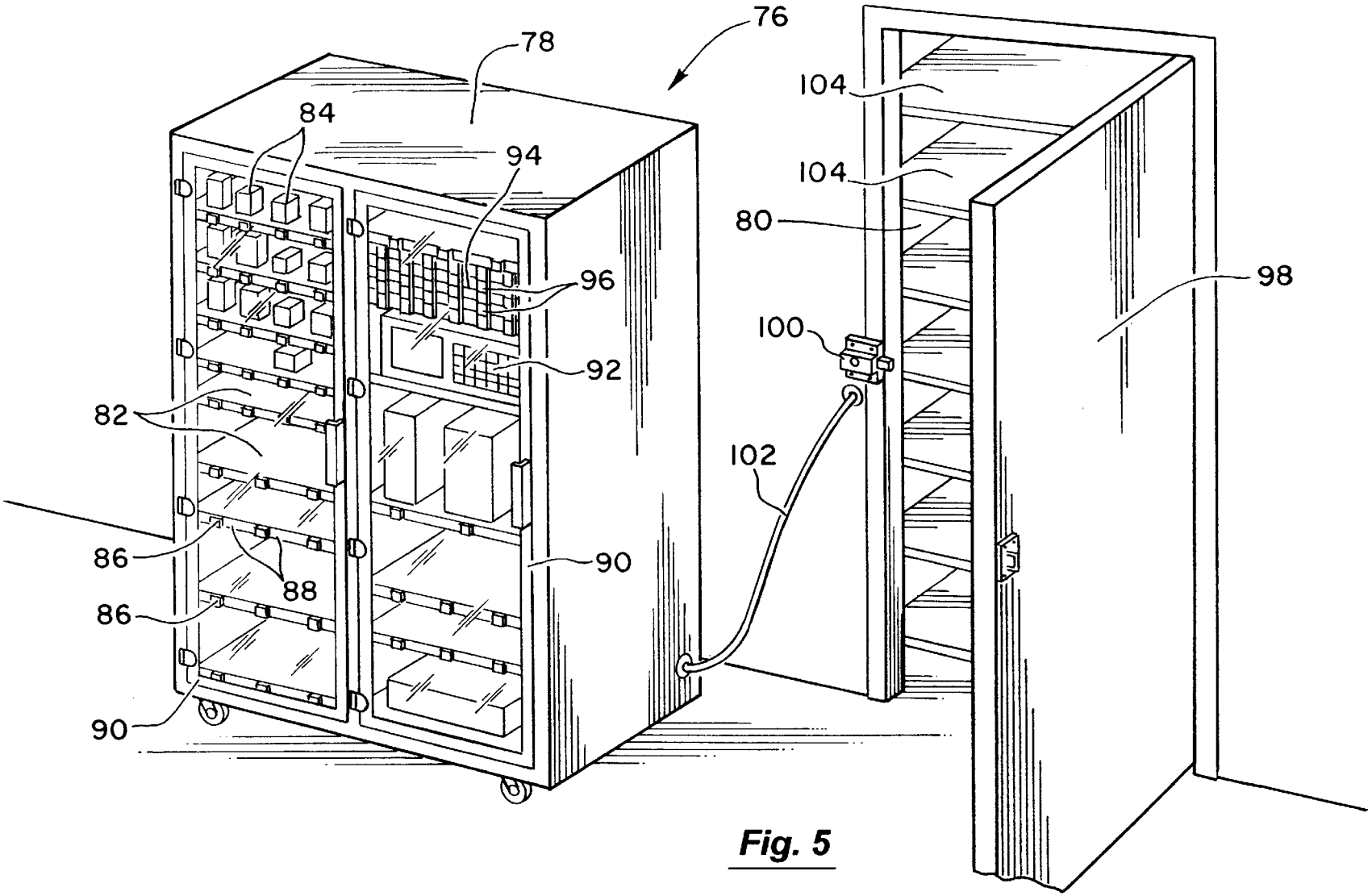
FIG. 5 illustrates an alternative embodiment of a dispensing system having a dispensing cabinet coupled to a lock on a closet according to the invention.

Referring now to FIG. 5, an alternative dispensing system 76 will be described. Dispensing system 76 comprises a dispensing cabinet 78 and a closet 80. As shown, dispensing cabinet 78 is similar to the dispensing cabinet described in U.S. Pat. No. 5,805,455, previously incorporated by reference. Dispensing cabinet 78 includes a plurality of shelves 82 holding items 84. Shelves 82 include a plurality of item buttons 86 for recording transfer of items to or from dispensing cabinet 78 in a manner similar to that previously described in connection with dispensing system 10. Adjacent each of item buttons 86 is a visual indicator 88 to assist the caregiver in locating a particular item. Alternatively, item buttons 86 may be configured to illuminate, thereby eliminating the need for visual indicators 88. Dispensing cabinet 78 further includes a plurality of doors 90 which prevent access to items 84 until unlocked in a manner similar to that described in connection with dispensing cabinet 12.

Dispensing cabinet 78 includes a processor 92 which is essentially identical to processor 24 of dispensing cabinet 12. Further, dispensing cabinet 78 includes a switch panel 94 having an array of item buttons 96 which correspond to particular storage locations within closet 80 in a manner similar to that described in connection with dispensing system 10.

Closet 80 includes a door 98 having an associated lock 100 which is essentially identical to lock 58 of dispensing system 10. An electrical cable 102 is employed to electrically couple processor 92 to lock 100. In this way, access to closet 80 may be prevented until the input of appropriate information into processor 92 as previously described. Closet 80 includes a plurality of shelves 104 for holding various supply items. Transfer of items to or from shelves 104 are recorded by pressing the appropriate item buttons 96 on panel 94 in a manner similar to that described with dispensing system 10.

Dispensing system 76 operates in a manner essentially identical to that previously described in connection with dispensing system 10. As such, access to items on shelves 104 is prevented until user identification information and charge account information are entered into processor 92 which will cause lock 100 to unlock. At the same time, various items may be removed from dispensing cabinet 78 and their removal recorded by operation of item buttons 86.

Although shown as a closet, it will be appreciated that dispensing cabinet 78 may be used to allow access into other rooms which have a lock similar to lock 100. In this way, existing storage space may easily and conveniently be adapted for use with an existing dispensing cabinet. Further, controlled access to the items is provided, while at the same time allowing for easy and convenient recording of transfers of items by simply operating the appropriate item buttons on the dispensing cabinet.

The invention has now been described in detail for purposes of clarity and understanding. However, it will be appreciated that certain changes and modifications may be practiced within the scope of the appended claims. Therefore, the scope and content of the application are to be determined in view of the attached claims as well as to the full scope of equivalents to which those claims are entitled.

What is claimed is:

1. A method for dispensing medical supply items, the method comprising:

providing a dispensing cabinet having a processor;

providing an auxiliary storage location which is separate from the dispensing cabinet and has at least one door and at least one lock to lock the door, wherein the lock is operable upon receipt of a signal from the processor, and wherein the auxiliary storage location holds at least one medical supply item;

entering into the processor user identification information and charge account information to cause the processor to send a signal to unlock the lock;

actuating an item sensor on the dispensing cabinet to record removal of the medical supply item from the auxiliary storage location; and removing the medical supply item from the auxiliary storage location.

2. A method as in claim 1, wherein the auxiliary storage location includes a plurality of items of the same type and further comprising actuating the item sensor a number of times corresponding to the number of desired items, and removing the desired number of items from the auxiliary storage location.

3. A method as in claim 1, wherein the auxiliary storage location includes a plurality of items of different types, wherein the dispensing cabinet includes a plurality of item sensors which correspond to the different types of items, and further comprising actuating the item sensors that correspond to the types of items that are desired to be removed, and removing the selected items.

4. A method as in claim 1, wherein the dispensing cabinet includes at least one door, a lock to lock the door, a plurality of medical supply items, and a plurality of dispensing cabinet-associated item sensors, wherein entry of the user identification and charge account information into the processor unlocks the dispensing cabinet door, and further comprising actuating one of the dispensing cabinet-associated sensors and removing one of the items from the dispensing cabinet which is associated with the actuated item sensor to record removal of the item from the dispensing cabinet.

5. A method as in claim 1, wherein the dispensing cabinet and the auxiliary storage location each include an exit button, and further comprising operating the exit button to send a signal to the processor to cause the processor to re-lock the locks on the dispensing cabinet and the auxiliary storage location.

6. A method as in claim 1, further comprising relocking the lock after a predetermined amount of time has expired.

7. A method as in claim 1, further comprising unlocking the lock prior to actuating the item sensor.

8. A method as in claim 1, further comprising entering into the processor a name of the medical supply item to be removed from the auxiliary storage location and lighting a visual indicator adjacent the item sensor that is associated with the entered medical supply item.

9. A method as in claim 8, further comprising entering the name of the medical supply item into the processor either before or after the lock is unlocked.

10. A method as in claim 8, further comprising selecting the name from a list of names stored in the processor.

11. A method as in claim 8, further comprising displaying a written description of the position of the entered item within the auxiliary storage location.

12. A method as in claim 3, further comprising periodically restocking medical supply items into the auxiliary storage location.

13. A method as in claim 12, further comprising generating a restock list with the processor prior to restocking.

14. A method as in claim 12, further comprising lighting visual indicators adjacent the item sensors which correspond to the types of items to be restocked.

15. A method as in claim 3, further comprising generating a list of items and associated quantities that are held within the auxiliary storage location from information stored in the processor, visually inspecting the auxiliary storage location to determine any discrepancies in the generated list, and updating the information stored in the processor to eliminate any discrepancies.

16. A method as in claim 15, wherein the updating step comprises entering user identification information into the processor, placing the processor into a cycle count mode, actuating the item sensors corresponding to items having a count discrepancy, and entering into the processor the correct quantity of the items stored in the auxiliary storage location.

17. A method for dispensing medical supply items, the method comprising:

providing a dispensing cabinet having a processor;

providing an auxiliary storage location which is separate from the dispensing cabinet and has at least one door and at least one lock to lock the door, wherein the lock is operable upon receipt of a signal from the processor, and wherein the auxiliary storage location holds at least one medical supply item;

entering into the processor user identification information and charge account information to cause the processor to send a signal to unlock the lock;

actuating an item sensor on the dispensing cabinet after the lock has been unlocked to record removal of the medical supply item from the auxiliary storage location; and removing the medical supply item from the auxiliary storage location.

18. A system for dispensing medical supply items, the system comprising:

a dispensing cabinet having a processor with an entry device to enter user identification information and charge account information into the processor;

an auxiliary storage location separate from the dispensing cabinet and having at least one door and a lock to lock the door, wherein the lock is operated upon receipt of a signal from the processor that is produced upon entry of the user identification information and charge account information into the processor; and wherein the dispensing cabinet further includes at least one item sensor which is in communication with the processor, wherein actuation of the item sensor after the lock has been unlocked records removal of an item from the auxiliary storage location.

19. A system as in claim 18, further comprising a plurality of auxiliary storage locations, wherein each storage location includes a lock which is operated upon receipt of a signal from the processor that is produced upon entry of the user identification information and charge account information into the processor.

20. A system as in claim 18, wherein the storage location is selected from the group of storage locations consisting of cabinets, closets and rooms.

21. A system as in claim 18, wherein the lock is electrically coupled to the processor.

22. A system as in claim 18, wherein the auxiliary storage location includes a plurality of storage areas for holding different types of items, wherein the dispensing cabinet includes a plurality of item sensors which correspond to the different types of items, and wherein the item sensors are actuated to record removal of the associated items from the storage areas.

23. A system as in claim 18, wherein the dispensing cabinet includes at least one door, a lock to lock the door, a plurality of medical supply items, and a plurality of dispensing cabinet-associated item sensors in communication with the processor, wherein entry of the user identification and charge account information into the processor unlocks the dispensing cabinet door, and wherein actuation of one of the dispensing cabinet-associated sensors records removal of one of the items from the dispensing cabinet.

24. A system as in claim 18, wherein the dispensing cabinet or the auxiliary storage location includes an exit button which is operable to send a signal to the processor to cause the processor to re-lock the lock.

25. A system as in claim 18, wherein the processor is configured to record removal of one item each time the item sensor is actuated.

26. A system as in claim 18, wherein the dispensing cabinet further includes a visual indicator adjacent the item sensor, and wherein the visual indicator is lighted upon entry of a name of the medical supply item into the processor.

27. A system as in claim 18, wherein the processor includes a cycle count mode to allow the stored quantities of items held in the auxiliary storage location to be manually adjusted.

28. A system as in claim 18, wherein the processor includes information on the position of items in the auxiliary storage location, and wherein the processor further includes a display screen to display a written description of each position.

29. A system as in claim 18, wherein the dispensing cabinet further includes a printer to print lists of information stored in the processor.

* * * * *